United States Patent [19]

Javeri

[11] 4,387,684

[45] Jun. 14, 1983

[54] IGNITION ADVANCE CIRCUIT WITH SENSOR INPUTS

[75] Inventor: Rupin J. Javeri, Elk Grove, Ill.

[73] Assignee: Motorola Inc., Schaumburg, Ill.

[21] Appl. No.: 310,004

[22] Filed: Oct. 13, 1981

[51] Int. Cl.[3] ..... F02P 5/04

[52] U.S. Cl. ..... 123/416; 123/487

[58] Field of Search ..... 123/416, 417, 643, 486, 123/487

[56] References Cited

U.S. PATENT DOCUMENTS

| | | | |
|---|---|---|---|
| 3,871,342 | 3/1975 | Fujinami et al. | 123/416 |
| 3,927,648 | 12/1975 | Kawai et al. | 123/416 |
| 4,015,565 | 4/1977 | Aono et al. | 123/416 |
| 4,167,923 | 9/1979 | Iwase et al. | 123/416 |
| 4,175,508 | 11/1979 | Wesenmeyer et al. | 123/416 |
| 4,284,045 | 8/1981 | Maier | 123/416 |
| 4,300,518 | 11/1981 | Petrie | 123/416 X |

*Primary Examiner*—Tony M. Argenbright
*Attorney, Agent, or Firm*—Margaret Marsh Parker; James S. Preistelski; James W. Gillman

[57] ABSTRACT

Sensor inputs as from an engine load sensor alter the frequency of a pulse providing circuit, the output of which adds counts to those counts provided as a function of engine velocity. The total number of counts is used for determining the instantaneous advance angle in a distributorless ignition system.

12 Claims, 7 Drawing Figures

IGNITION ADVANCE CIRCUIT WITH SENSOR INPUTS

CROSS REFERENCE TO RELATED APPLICATIONS

The present invention is related to the inventions described and claimed in copending U.S. patent applications Ser. No. 310,029 and Ser. No. 310,018, filed as of even date with the present application. Both of these copending U.S. Applications are assigned to the same assignee as is the present invention.

BACKGROUND OF THE INVENTION

This invention relates to the field of distributorless electronic ignition systems and, more particularly, to systems wherein the desired advance angle is a function of other engine characteristics in addition to speed.

In an internal combustion engine the timing of the ignition spark is of extreme importance to the operation of the engine. Various mechanical arrangements have been designed, generally utilizing centrifugal force to provide spark advance with speed. Because such arrangements required readjustment from time to time and did not lend themselves to precise or sophisticated advance curves, electronic advance (distributorless) ignition systems have been developed.

In one of these, described in U.S. Pat. No. 4,104,997, a "programmable" voltage slope generator, including a capacitor and various current sources, produces a signal voltage having more than one rate of change. An engine rotation sensor and timer combination alter the rate of change of voltage in response to varying engine speeds. A vacuum sensor also provides an input to the programmable generator in response to changes in engine load. The voltage on a capacitor in the generator is compared with a reference voltage and when the levels are equal, a spark timing pulse is produced which enables the firing of the appropriate cylinders. While this analog approach is a big improvement over mechanical arrangements, even greater accuracy has proven desirable.

In a subsequent U.S. Pat. No. 4,168,682, a digital circuit was shown wherein signals from various engine condition sensors produce a train of pulses representing the desired angle of advance for each instantaneous combination of engine conditions. These pulses are multiplexed and coupled to a binary rate multiplier (BRM) which outputs to a counter. A second counter monitors the input to the BRM and controls the output of a ROM which controls the multiplication rate of the BRM. The BRM output then controls the input to a phase counter which, in turn, controls the actual spark timing.

Still another U.S. Pat. No. 4,231,332, describes an improvement upon the circuits of the two previous patents. (All three of the patents referred to herein are assigned to the assignee of the present invention.) In this latter circuit, again sensor pulses are combined and inputted to a ROM which also receives the crankshaft position pulses and controls a BRM which, in turn, inputs to a series of counters. The accumulated count then determines the timing of the ignition spark. This system utilizes less storage in the ROM than the previous version, '682, but still more than is desirable. While all of the above-described systems provide an increase in accuracy of the advance angle calculation, all leave room for improvement.

SUMMARY OF THE INVENTION

It is, therefore, an object of the present invention to provide a means of varying the ignition advance angle in response to conditions such as load or temperature.

It is a particular object to provide this means independently of engine speed and under control of a master clock.

It is another object to provide this means using a minimum of memory storage while obtaining improved accuracy in the desired advance curve.

These and other objects are obtained in a circuit wherein signals representing engine speed are coupled to a counter, the output of which addresses a ROM which is programmed with the desired speed vs. advance angle curve. The ROM output is coupled through a binary rate multiplier to an exclusive-OR circuit. Other sensor inputs responsive to load, temperature, etc., are used to control the frequency of a voltage controlled oscillator. The oscillator control signal can be simply in proportion to the instantaneous load (vacuum) or can also include proportional inputs from temperature sensors or a step function such as may be provided by a throttle switch. Pulses derived from the VCO output are also coupled to the EXOR circuit and the output therefrom is fed to an advance up counter for controlling the advance angle.

DETAILED DESCRIPTION OF THE PREFERRED EMBODIMENT

Figure 1:
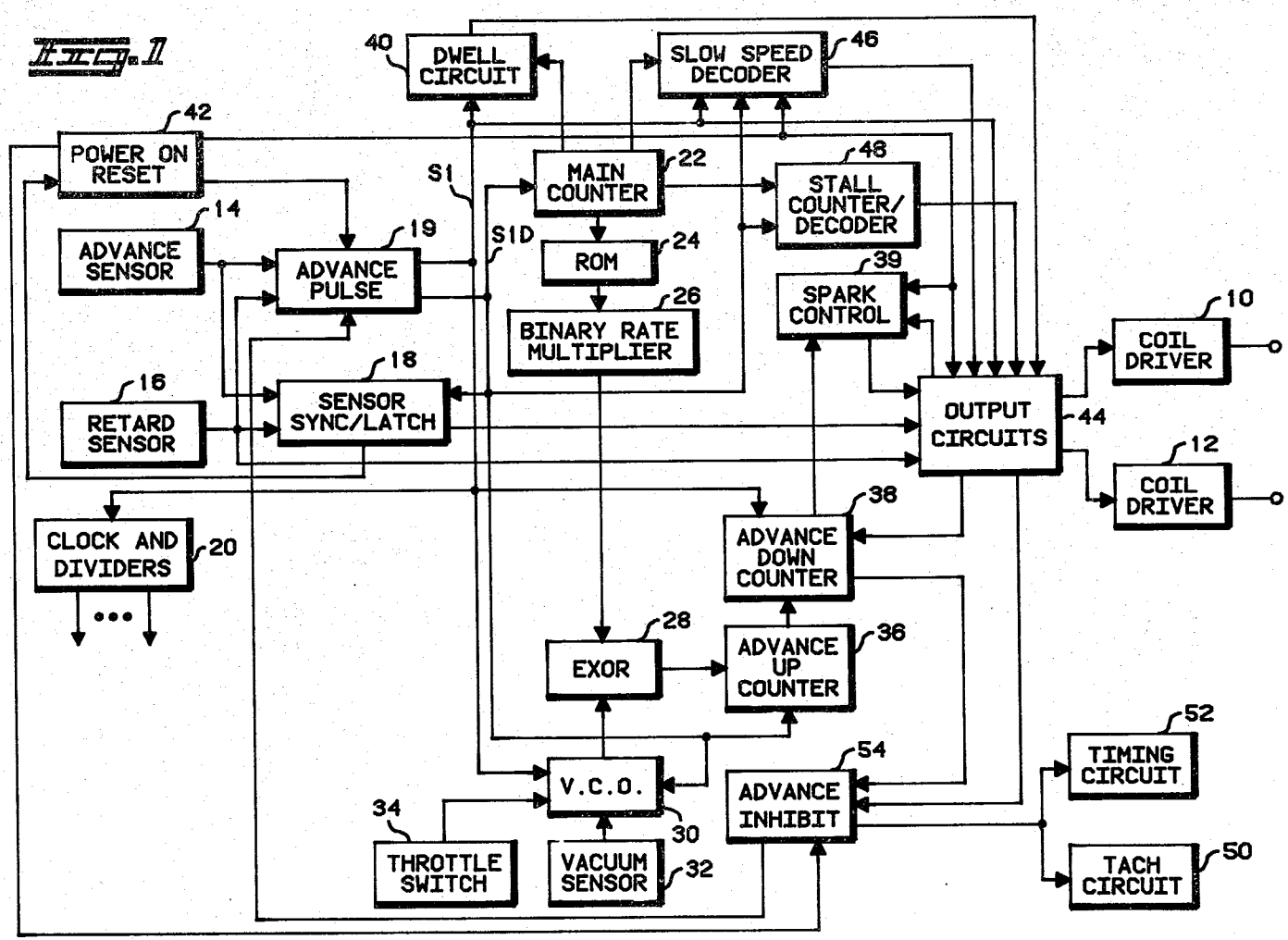
FIG. 1 is a block diagram of the general system including the invention.

The block diagram of FIG. 1 illustrates a four cylinder automobile ignition system which includes one embodiment of the present invention. The system is an electronic ignition (distributorless) system which is well suited to integrated circuit implementation. The invention is, however, not to be construed as limited to this particular system or to IC implementation but, rather, may be more easily understood in this environment.

As may be seen, two coil driver circuits 10, 12 are shown, each for energizing one coil, each coil supplying a spark to two cylinders (not shown), one during its power stroke and one during its exhaust stroke.

Figure 2A:
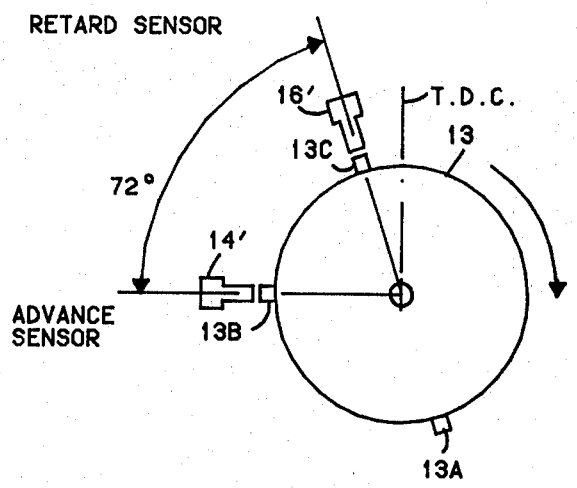
FIG. 2A is a diagram illustrating the positioning of the engine speed sensors and the tabs on the crankshaft.
Figure 2B:
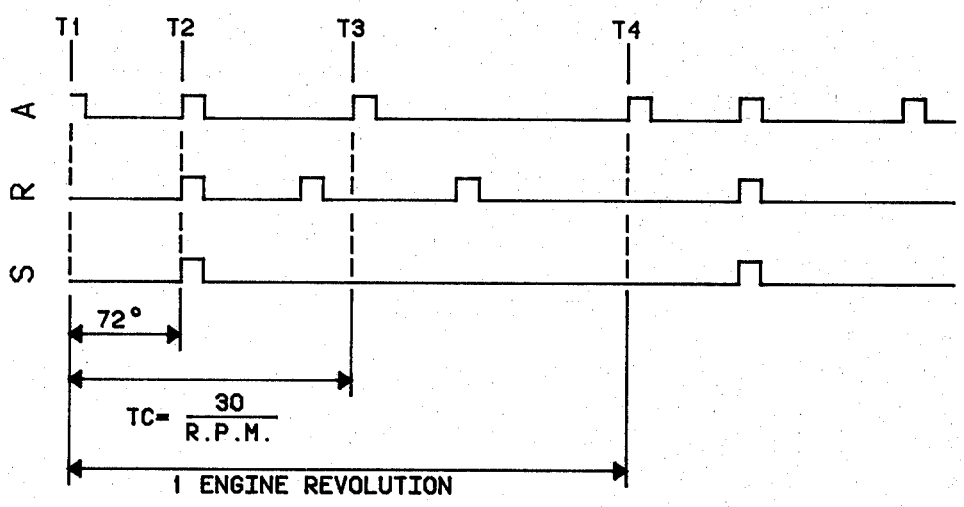
FIG. 2B is a timing diagram relating to FIG. 2A.

In FIG. 2A there are three projections or tabs 13*a*, 13*b*, 13*c* on a flywheel 13 of an engine (engine not shown). The projections are sensed by two proximity (Eddy current) sensors 14', 16', which are part of an "advance" sensor circuit 14 and a "retard" sensor circuit 16, respectively, as seen in FIG. 1. From FIG. 2A, it can be seen that only once per crankshaft revolution (at T2 of FIG. 2B) will there be simultaneous pulses from the two sensors. This allows for a relatively exact determination of engine (crankshaft) position. FIG. 2B is a timing chart of the pulses derived from the advance (A) and retard (R) sensors. From the three output pulses per cycle from each of these sensors, a synchronizing pulse (S) is obtained by a sensor synchronizing pulse circuit 18. This synchronizing pulse is used to determine which coil driver (10 or 12) is to be enabled at a given time. An advance pulse circuit 19 provides an advance control signal (S1) in response to the leading edge of one of the advance sensor pulses and also provides a one-clock-pulse delay for the advance control signal. S1 and the delayed signal (S1D) are used extensively for timing in the circuit, including the circuit of FIG. 3. A clock and associated dividers 20 provide a number of clock signals which are used in the various circuits described hereinafter (clock signal inputs not shown here). A main counter 22 counts clock pulses between each two S1 pulses, thus the maximum count depends directly on engine speed. The counter 22 outputs are coupled to a ROM 24 and each count constitutes an address, thus the number of addresses accessed between S1 pulses depends on engine speed. The data stored at each address in the ROM is a function of engine speed, the ROM having been programmed to provide the desired advance curve with respect to speed. The ROM output data is coupled to a binary rate multiplier (BRM) 26 which also has inputs from the clock/ dividers 20. The BRM is coupled to one input of an exclusive-OR gate 28. A voltage controlled oscillator (VCO) 30 is controlled by inputs from a vacuum (manifold pressure) sensor 32 and (optionally) a throttle switch 34 or other input circuits (not shown). The VCO output is coupled to a second input of the EXOR 28, which then performs a gating function on the two sets of input pulses. That is, unless two pulses have exactly coincidental leading or trailing edges, each EXOR input pulse will be represented by one output pulse. The output of the EXOR 28 is coupled to an advance upcounter 36 which increments from one S1D pulse to the next. The count in the advance upcounter 36 is transfered to an advance down counter 38 once during each cycle but, since the down counter 38 is clocked at a higher rate than the up counter 36, the countdown requires less time than the count up. At the end of the advance countdown, a spark control circuit 39 may enable the spark for the appropriate cylinders.

Since the dwell time must be controlled for all engine speeds, it is necessary to "count back" from the required spark time in order to determine the beginning of the dwell time. This is done by a dwell counter 40 which also receives the maximum count from the main counter 22. The count in the dwell counter is rapidly decremented a fixed number of counts, then held until spark time occurs, then decremented at the same rate as the main counter. Dwell may be enabled at the zero count of the dwell counter.

A power-on-reset circuit (POR) 42 prevents any cylinder from being fired initially until the sensor sync pulse circuit 18 has determined the flywheel position, thus preventing the wrong cylinder from being fired. Gating circuits in an output logic circuit 44 process the spark control signals being coupled to the coil drivers 10 and 11. A slow speed decoder 46 detects any overflow of the main counter 22 (which would indicate a low speed condition) and forces the spark to occur with no advance angle calculation. A counter in a "stall" decoder 48 includes counter stages coupled to the last stage of the main counter 22, and when the stall decoder counter overflows (indicating that engine speed is going into a "stall" condition), primary coil current is slowly decreased to zero and the whole system is shut down. A signal from an advance inhibit circuit 54 inhibits any advance pulses during the spark period and can also be coupled to a tachometer circuit 50 or any other timing circuit 52 requiring a direct correlation with engine speed, such as a control for fuel injection.

Figure 3:
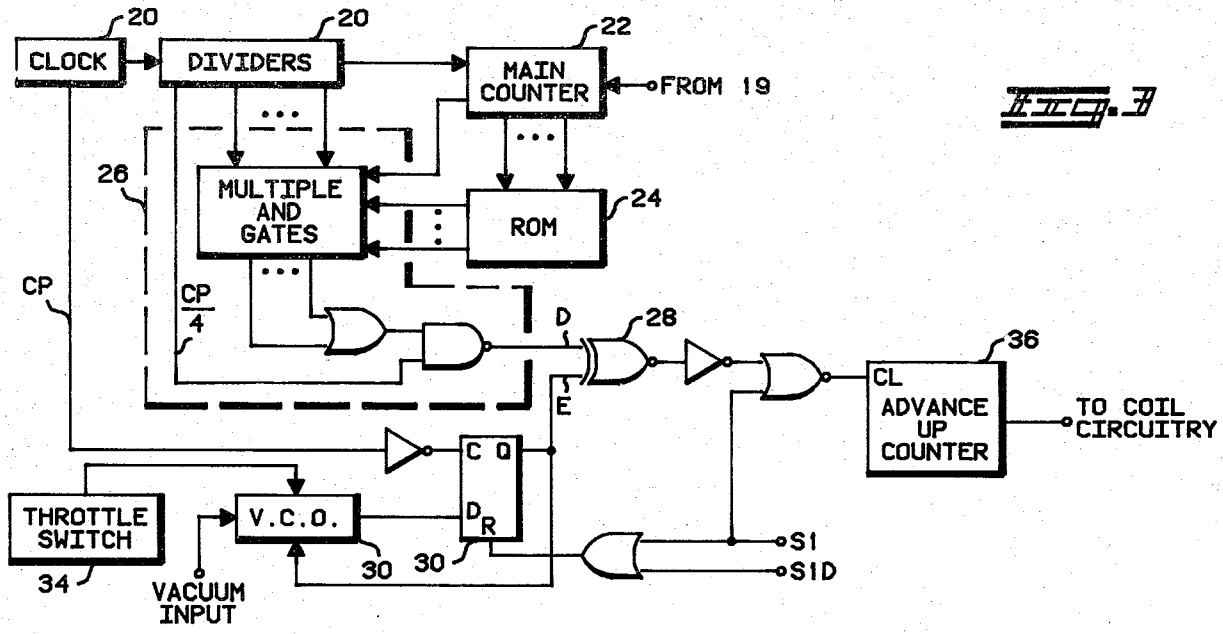
FIG. 3 is a block and logic diagram of one embodiment of the invention.

In FIG. 3, more detail is shown in the circuit of the preferred embodiment of the invention. The clock 20 is preferably an oscillator at 135 KHz. The dividers 20 are flip flops or divide-by-two stages. The main counter 22 and the advance up counter 36 could be MC14040B binary counters.

Figure 4:
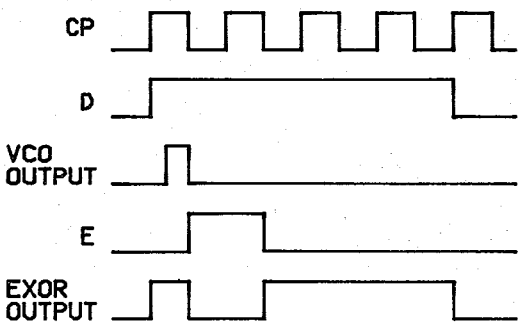
FIG. 4 is a timing diagram relating to the diagram of FIG. 3.

The wave forms of FIG. 4 relate to the manner in which the appropriate counts are provided to the input of the advance up counter 36 by the circuit of FIG. 3. As described hereinabove, one function of the S1 pulse, as derived from the advance and retard sensors, is to time the crankshaft period rotation. Clock pulses (CP divided down) between each two S1 pulses are accumulated in the main counter 22. Each count at the counter 22 output constitutes an address for the ROM 24. The ROM is programmed in accordance with the particular desired curve of advance angle data; e.g., the first addresses typically provide small outputs, while the later outputs are larger. At slower speeds, more numbers will go into the main counter 22, more ROM addresses will be accessed, and many more counts will be outputted by the BRM 26. The output pulses from the BRM are clocked by CP or by CP divided down, (as by four), providing the signal pulses D which are synchronized with the rising edge of the clock pulse and coupled to the EXOR 28.

The VCO 30 output pulses are clocked by CP, providing signal pulses E which are synchronized with the falling edge of the clock pulse and also coupled to the EXOR 28. Thus the output pulses of the EXOR are equal in number to the total number of the pulses D and E. It may be seen that the output F/F in the VCO 30 is reset by a pulse which is the partial sum of S1 and S1D.

Figure 5:
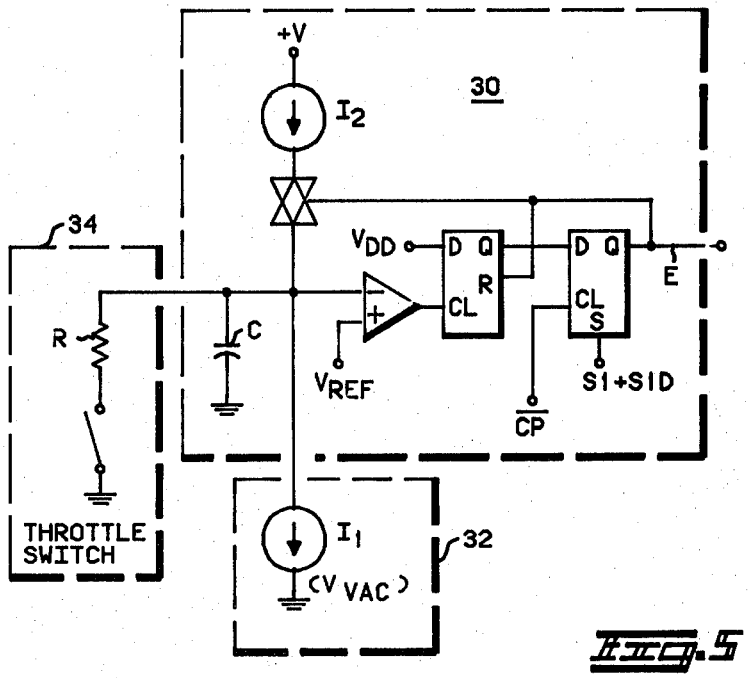
FIG. 5 is a logic diagram of a portion of the diagram of FIG. 1.
Figure 6:
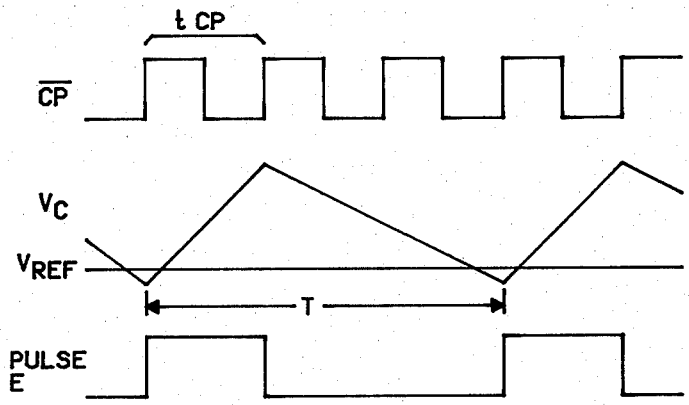
FIG. 6 is a timing diagram relating to the diagram of FIG. 5.

FIGS. 5 and 6 are a diagram of an embodiment of the VCO 30 and the corresponding timing diagram, respectively. The vacuum sensor circuit 32 is shown here as a current source controlled by $V_{VAC}$, the output of a vacuum sensor. It will be seen that, since $I_1T/C=T_2tcp/C$, where T is the output period, tcp is the period of CP, and C is the absolute value of a capacitor C, T is directly proportional to tcp and the ratio of current sources, ($T=tcp\ I_2/I_1$) and is independent of the absolute capacitor value and of the reference voltage.

The throttle switch 34 is activated at the top position of the gas pedal and is used to take out most or all of the advance when the engine is running very slowly, and the vacuum sensor would be calling for advance. This feature will help to meet pollution standards. If the optional throttle switch circuit 34 is included, a step function is provided to the input of the comparator of VCO 30, since the circuit 34 would alter the charge/discharge of the capacitor C. Since the capacitor C is discharged on every reset pulse, the output pulses are synchronized from that point on every cycle. It will be seen that other inputs to the VCO could be provided if desired, either as variable functions or step functions of other engine or environmental characteristics. Other embodiments for the VCO may also be employed if the control functions as here described are also available.

Thus, the circuit of the invention provides a constant retard angle correction for a given load condition independently of the engine speed advance calculation. This is due to the direct proportionality of the number of VCO output pulses to engine load conditions. By combining the VCO output with the BRM output (from the ROM) in the EXOR circuit shown and described herein, rather than adding pulses to the BRM input as in the prior art, the consistency of the advance angle calculations is greatly improved, particularly at high engine speeds by removing the "jitter" effect in the spark timing due to the lack of synchronization in the prior art. The circuit of the present invention greatly simplifies the implementation of the combination of two or more functions, as in spark timing. Other variations and modifications of the present embodiment are possible and it is intended to cover all such as fall within the spirit and scope of the appended claims.

What is claimed is:

1. An ignition advance control circuit as for a spark ignition engine having a crankshaft and comprising:

first input means for supplying a first input signal in response to crankshaft rotation;

counter means coupled to the first input means and having an output count which is inversely proportional to crankshaft velocity;

first pulse providing means coupled to the counter means output for providing a first output signal wherein the number of pulses per crankshaft rotation is a predetermined function of said output count;

second input means for providing a second input signal whose amplitude is a function of an engine characteristic other than velocity;

second pulse providing means coupled to the second input means for providing a second output signal whose frequency is a function of the amplitude of the second input signal;

adder means coupled to the first and second pulse providing means for providing a third output signal which is substantially the sum of the first and second output signal pulse rates; and means coupled to the adder means for controlling spark timing in an engine in response to the adder means output signal under at least some engine conditions.

2. An ignition advance control circuit according to claim 1 and wherein the first input means includes sensors for sensing crankshaft rotation.

3. An ignition advance control circuit according to claim 1 and wherein the second input means includes a vaccuum sensor for sensing the engine loading condition.

4. An ignition advance control circuit according to claim 1 and wherein the second input means includes means for receiving a signal in response to throttle position.

5. An ignition advance control circuit according to claim 1 and wherein the second input means includes a sensor for providing an input in response to temperature.

6. An ignition advance control circuit according to claim 1 and wherein the second input means includes means for providing analog sensor signals and means for providing step function signals.

7. An ignition advance control circuit according to claim 1 wherein the adder means performs an exclusive-OR function.

8. An ignition advance control circuit according to claim 1 and wherein the second pulse providing means includes a voltage-controlled oscillator.

9. An ignition advance control circuit having the proper advance angle controlled on a continuing basis by a counter in a logic circuit, the maximum counts of the counter per crankshaft rotation being used to determine the advance angle under at least some engine conditions, the circuit comprising:

first input means for providing a first input signal in response to crankshaft rotation;

logic means coupled to the first input means for providing a first output signal wherein the number of pulses per crankshaft rotation is a function of the desired advance angle for the instantaneous engine velocity;

second input means for providing a second input signal whose amplitude is a function of an engine characteristic other than velocity;

pulse providing means coupled to the second input means for providing a second output signal whose frequency is a function of the second input signal amplitude;

combining means for adding the number of pulses of the first and second output signals; and means coupled to the combining means for controlling spark timing in an engine in response to the output signal of the combining means under at least some engine conditions.

10. An ignition advance control circuit according to claim 9 and wherein the combining means comprises a logic element for providing an exclusive-OR function.

11. An ignition advance control circuit according to claim 10 and wherein the first input signal provides a reset signal for the logic means and the pulse providing means.

12. An ignition advance control circuit according to claim 10 and wherein the logic means further includes a clock for providing a first clock signal for synchronizing the logic means, and a second clock signal for synchronizing the pulse providing means, one of said clock signals being the inverse of the other said clock signals.

* * * * *